US005904061A

United States Patent [19]

Engel et al.

[11] Patent Number: 5,904,061

[45] Date of Patent: May 18, 1999

[54] METHOD OF ROLLING FINISHED SECTIONS FROM A PRELIMINARY SECTION

[75] Inventors: Georg Engel; Paul Josef Mauk, both of Düsseldorf; Hans-Jürgen Nowak, Kamp-Lintfort; Ulrich Svejkovsky, Wuppertal, all of Germany

[73] Assignee: SMS Schloemann-Siemag Aktiengesellschaft, Düsseldorf, Germany

[21] Appl. No.: 08/891,151

[22] Filed: Jul. 10, 1997

[30] Foreign Application Priority Data

Jul. 13, 1996 [DE] Germany ..... 196 28 369

[51] Int. Cl.[6] ..... B21B 41/06; B21B 13/10; B21B 31/07

[52] U.S. Cl. ..... 72/229; 72/225; 72/238

[58] Field of Search ..... 72/200, 201, 202, 72/229, 227, 226, 228, 365.2, 336.2, 238, 239

[56] References Cited

U.S. PATENT DOCUMENTS 4,791,799 12/1988 Engel et al. ..... 72/239

5,664,452 9/1997 Engel et al. ..... 72/229

*Primary Examiner*—Joseph J. Hail, III

*Assistant Examiner*—Rodney Butler

*Attorney, Agent, or Firm*—Friedrich Kueffner

[57] ABSTRACT

A method of rolling finished sections from a preliminary section by initially carrying out five or more passes and reversing passes between a universal stand and a horizontal stand, wherein profiled horizontal rolls of the universal stand form in the section two indentations located opposite of each other and offset relative to a longitudinal center of the section. Subsequently, head and flange projections of an emerging rail section are preshaped and the indentations are laterally reduced by one of alternative grooves of a horizontal stand of a preliminary rolling group. The emerging rail section is rolled in a reversing operation after three or more passes in the universal stand and in two alternative grooves of an intermediate upsetting stand. The section is finish-rolled into a rail section in an additional pass through the universal stand.

6 Claims, 6 Drawing Sheets

VP
V1
V2
V3
V4
VW
VW
VVG
H1
WH1
VHG
H2
WH2
RH2
WH2
H2
WH2
QE
U1
U2
U3
U4
U5
E1
E2
E3
WE1
WE2
WE3
EUG
SZG
HW
HW
AUG

WH1
WH2

WE1
WE2
WE3

METHOD OF ROLLING FINISHED SECTIONS FROM A PRELIMINARY SECTION

BACKGROUND OF THE INVENTION

1. Field of the Invention

The present invention relates to a method of rolling finished sections from a preliminary section by means of an arrangement which operates in a reversing operation and includes a compact rolling group composed of a first universal stand on an entry side, a second universal stand on an exit side and an intermediate upsetting stand arranged between the first and second universal stands, wherein a preliminary rolling group composed of two or more roll stands and having a free rolling stock run-out is arranged in front of the compact rolling group and transversely offset and parallel to the rolling line of the compact rolling group and a transverse shifting unit arranged between the two rolling lines is arranged in front of the compact rolling group.

2. Description of the Related Art

In known methods and in roll stand arrangements operated according to these methods, blooms produced, for example, by a continuous casting plant are supplied to an intermediate storage in which they are cooled to room temperature, the quality of the blooms is evaluated and, after again heating the blooms to rolling temperature, the blooms are rolled into rails in the roll stand arrangement. After heating to rolling heat, the block-shaped blooms are preshaped in a preliminary rolling procedure in at least one two-high reversing stand, however, usually in two such stands. Finish rolling also took place in three-high reversing stands or two-high reversing stands; however, recently finish rolling is carried out more frequently in universal stands.

It has also been proposed in the past to carry out this shaping process in a fully continuously operating roll stand plant with the appropriate large number of roll stands and the drives thereof.

In all these methods, it is attempted to produce rails in rolling lengths which are as long as possible and to conduct these long rolling lengths as much as possible at rolling heat through head hardening or tempering plants or other heat treatment plants, wherein the rails treated in this manner were subsequently cooled, straightened, the quality evaluated and cut to length.

These known methods have the following disadvantages:

The large number of shaping passes required for preliminary rolling requires large reversing stands because of the large lengths of the roll bodies required for the large number of shaping passes; this also means that the rolls themselves are expensive, and complicated manipulating devices for introducing the rolling stock into the various passes are required. The long rolling lengths result in relatively long times required for the reversing rolling operation and, consequently, do not make it possible that such plants are operated in the same operating cycle as a continuous casting plant. For this reason, it is in such a case always necessary to provide a relatively large intermediate storage if a combined operation between continuous casting plant and rolling plant is to be carried out.

Because of the large number of shaping passes, at least six to eight roll stands with the drives thereof are required for fully continuous rolling. This results in correspondingly high investment costs, high costs for the large number of rolls and for the exchange and refinishing of the rolls.

Moreover, when carrying out this continuous preliminary rolling and an also continuous finish rolling, different temperatures over the rolling length cannot be avoided, wherein these different temperatures produce so-called temperature wedges between the beginning and the end of the rolling length caused by the relatively slow entry speed into the first stand of the rolling train. These temperature wedges must be compensated or regulated in order to meet the requirements of the rolling stock which are required for the head hardening or tempering plants or the heat-treatment plants.

It is frequently required to combine a production of a small number of rails with the production of girders. The above-described conventional rail rolling methods can only be realized with a very large number of additional devices when using the known, above-mentioned plants for rolling finished sections from a preliminary section which all operate in a combined operation with a continuous casting plant, i.e., without a conventional reversing preliminary stand.

SUMMARY OF THE INVENTION

Therefore, it is the primary object of the present invention to carry out rolling of rails in roll stand arrangements of the above-described type, wherein either continuously cast rectangular blooms or preliminary sections already cast in the preliminary shape are used as initial products.

In accordance with the present invention, when at least one roll stand of the preliminary rolling group and/or a roll stand of the compact rolling group is equipped with several alternative grooves which can be moved into and out of rolling position by transversely shifting the rolls or the roll stands or the rolling stock conducted through the roll stands, the shaping of the rectangular or preshaped preliminary section is carried out in the roll stands of the preliminary rolling group in a reversing operation in a number of shaping and reducing passes by using the alternative grooves, and subsequently rolling in the compact rolling group also in a reversing operation with several shaping and reducing passes in the universal stand on the entry side and in the intermediate upsetting stand by again using the alternative grooves, and subsequently finish rolling in the universal stand on the exit side to produce the finished section.

When the preliminary rolling group is equipped with a universal stand and a horizontal stand having two alternative grooves and the intermediate upsetting stand of the compact rolling group is also equipped with two alternative grooves, shaping of a rectangular preliminary section into a rail section can be started with 5 or more passes and reversing passes between the universal stand and the horizontal stand in each rolling group, wherein profiled horizontal rolls of the universal stand form in the section to indentations which are located opposite each other and offset relative to the longitudinal center of the section, wherein, subsequently, the head and flange projections of the emerging rail section are preshaped and reduced laterally of the indentations by means of one or the other alternative groove of the horizontal stand of the preliminary rolling group, wherein, the emerging rail section is rolled in a reversing operation after three or more passes in the universal stand on the entry side of the compact rolling group and the two alternative passes of the intermediate upsetting stand, and wherein the section is finish rolled into the rail section in another pass through the universal stand on the exit side.

When a dog bone-shaped preliminary section is used instead of the aforementioned rectangular preliminary section, the indentations in the center of the preliminary section can be formed in accordance with the above-described method by using the profiled rolls of the universal stand of the preliminary rolling group.

When using a rail section-like preliminary section instead of a rectangular preliminary section and when using a vertical roll stand instead of the above-mentioned universal stand in the preliminary rolling group, the preliminary section can also be subjected to an upsetting operation at both ends and the intermediate upsetting stand of the compact rolling group may have three alternative grooves, wherein the preliminary section is dimensioned in such a way that its flange projections correspond to 1.2 to 4 times the head width and the other flange corresponds to 1.2 to 3 times the base width of the finished rail section.

When using a preliminary section having a plug-shaped cross-section instead of a rectangular preliminary section and when using only a horizontal stand or a trapezoidally-shaped cross-section with the use of the vertical preliminary stand of the preliminary rolling group with three alternative grooves as preliminary stand, the preliminary section can be preshaped in a reversing operation with three successive passes carried out in the three alternative grooves.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
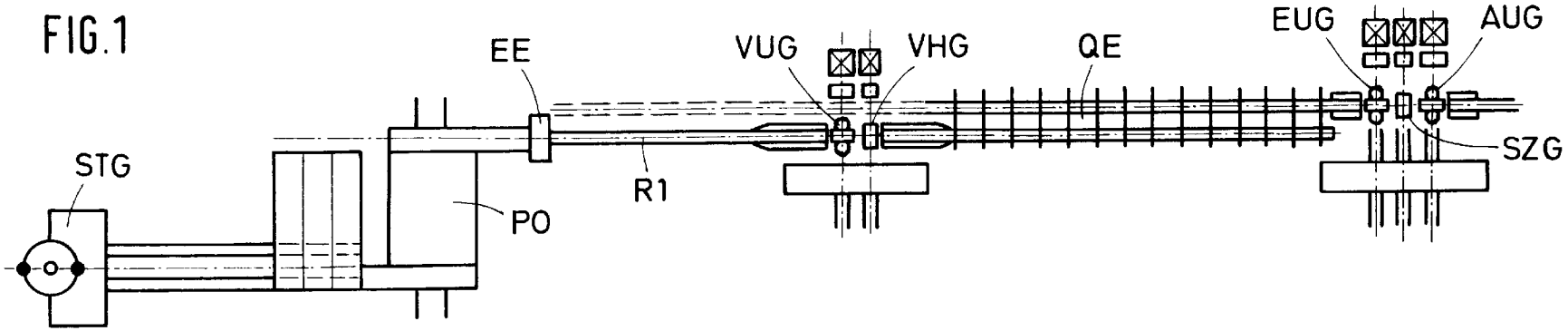
FIG. 1 is a schematic top view of a roll stand arrangement for carrying out the method according to the present invention.

The roll stand arrangement according to FIG. 1 includes a continuous casting plant STG which is following by a reheating and buffer furnace PO and the furnace PO, in turn, is followed by a descaling unit EE. The preliminary sections pretreated in this manner and arriving from the continuous casting plant STG are supplied through a roller conveyer R1 to the preliminary rolling group which, in the illustrated embodiment, is composed of a universal stand VUG and a horizontal two-high stand VHG. The preliminary rolling group has a free rolling stock run-out. By using a transverse conveyor unit QE arranged following the preliminary rolling group, the prerolled preliminary section is then supplied to the compact rolling group which is composed of a universal stand EUG on the entry side, a universal stand AUG at the exit side and an intermediate upsetting stand SZG arranged between the two universal stands.

Figure 2:
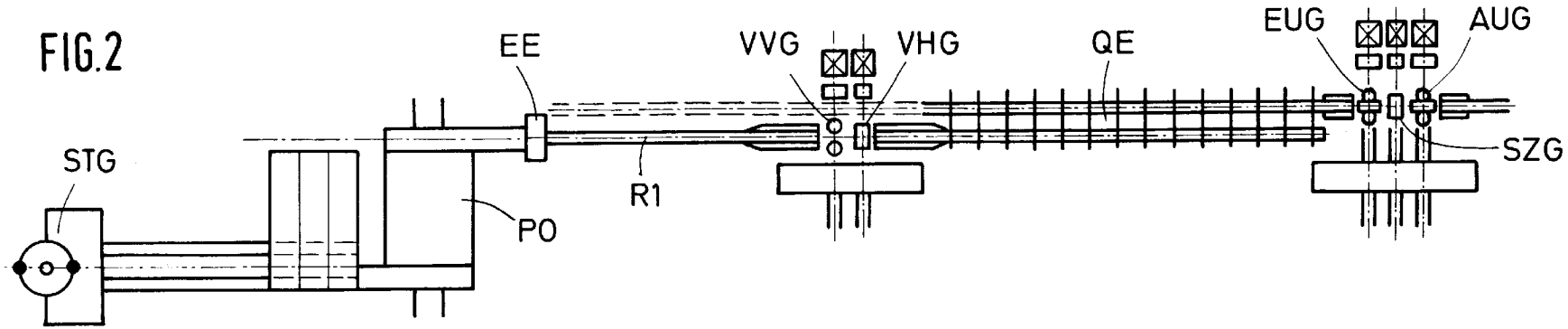
FIG. 2 is a view similar to FIG. 1, showing a different embodiment of the roll stand arrangement.

The arrangement shown in FIG. 2 corresponds to that of FIG. 1 with the exception that a two-high vertical stand VVG is provided in the preliminary rolling group instead of the preliminary universal stand VUG.

Figures 3, 3A, 3B:
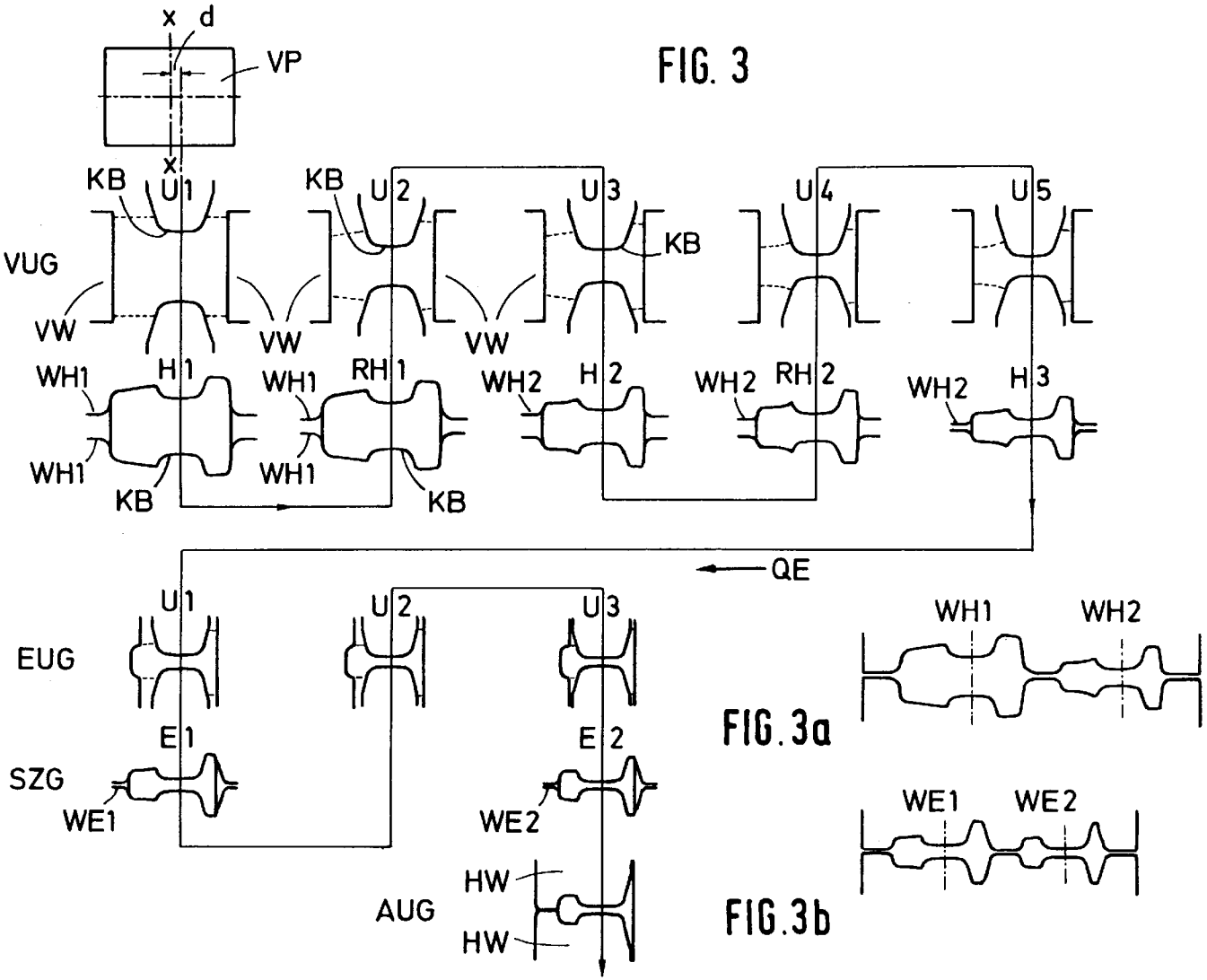
FIGS. 3, 3*a*, 3*b* and FIGS. 4, 4*a*, 4*b* show rolling schedules for carrying out the method in the roll stand arrangement according to FIG. 1.

The rolling schedule of FIG. 3 shows the pass sequence for the production of a so-called Vignoles's rail from a continuously cast preliminary section VP having a rectangular cross-section. An indentation KB which is offset by a distance d relative to the vertical longitudinal center x-x of the preliminary section VP is formed in this section by carrying out a first pass U1 in the universal stand VUG of the preliminary rolling group by means of the profiled horizontal rolls HW1; the vertical rolls VW secure the intended width of the cross-section. In the following pass H1, the mass distribution in the cross-section of the preliminary section is effected in the alternative groove WH1, shown in FIG. 3*a*, of the horizontal two-high stand VHG of the preliminary rolling group and in a subsequent reversing pass RH1 so as to form a preliminary rail section having an appropriate cross-section. This mass distribution and the increase of the indentation KB are then achieved by a subsequent pass U2 in the reversing direction through the universal stand VUG, a subsequent reversing pass U3 through the universal stand VUG, a subsequent pass H2 and a reversing pass RH2 through the second alternative groove of the horizontal two-high stand VHG, and a subsequent pass U4 and a subsequent reversing pass U5 again through the universal stand VUG and a subsequent final pass H3 through the second alternative groove WH2 of the horizontal two-high stand VHG from the preliminary rolling group through the transverse shifting unit QE with a pass U1 into the universal stand EUG on the entry side of the compact rolling group and with another pass E1 to the alternative groove WE1, shown in FIG. 3*b*, of the intermediate upsetting stand SZG and, from the intermediate upsetting stand SZG for one pass U2 and a reversing pass U3, the section is again introduced into the universal stand EUG on the entry side and then once again in the intermediate upsetting stand SZG, in this case into the second alternative groove WE2, shown in FIG. 3*b*, and the section is subsequently finish rolled into the Vignoles's rail cross-section with one pass in the profiled horizontal rolls HW of the universal AUG on the exit side.

As is apparent from the above description, the preliminary rolling group is used for carrying out, starting from the rectangular cross-section, an asymmetrical material distribution which corresponds to the mass distribution necessary for the first pass in the following finish rolling group.

Figures 4, 4A, 4B:
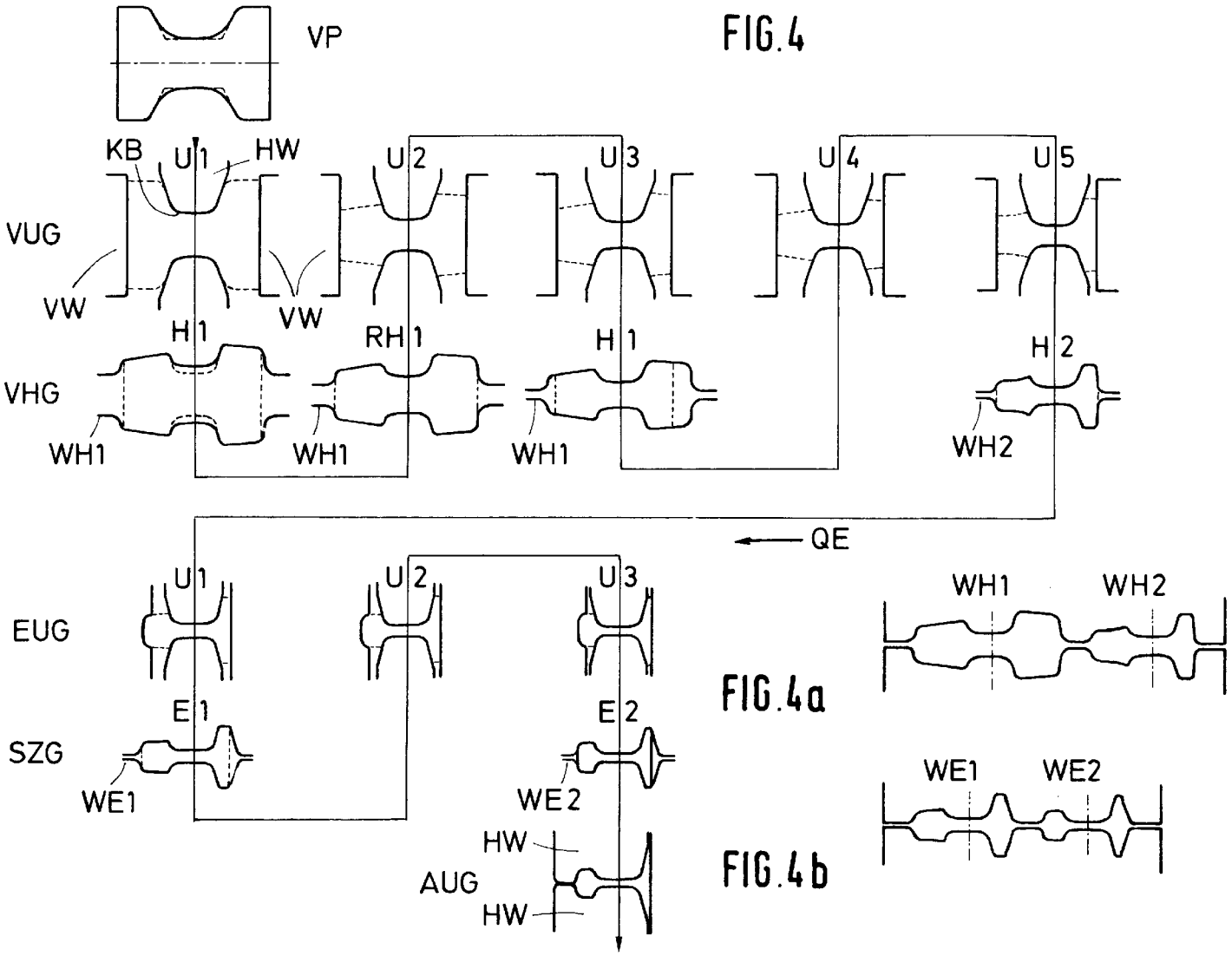

When rolling is carried out in accordance with the rolling schedule shown in FIG. 4, a preliminary section VP is used which has an increased thickness at both ends, i.e., a so-called dog bone-shaped section, wherein this section is also produced in a continuous casting plant. The pass sequences in the preliminary rolling group correspond to that of FIG. 3 with the exception that, after leaving the universal stand VUG after the third pass U3, the preliminary section VP is once again conducted through the first alternative groove WH1 of the intermediate upsetting stand VHG and is then rolled in a reversing direction with a pass U4 and a reversing pass U5 by the universal stand, is then rolled in a single groove H2 by the second alternative pass of the horizontal two-high stand VHG, shown in FIG. 4*a*, and subsequently is moved by the transverse conveying unit QE to the compact rolling group and is rolled with a pass sequence corresponding to the illustration of FIG. 3 using the two alternative passes WE1 and WE2 of the intermediate upsetting stand SZG according to FIG. 4*b*.

Figures 5, 5A, 5B:
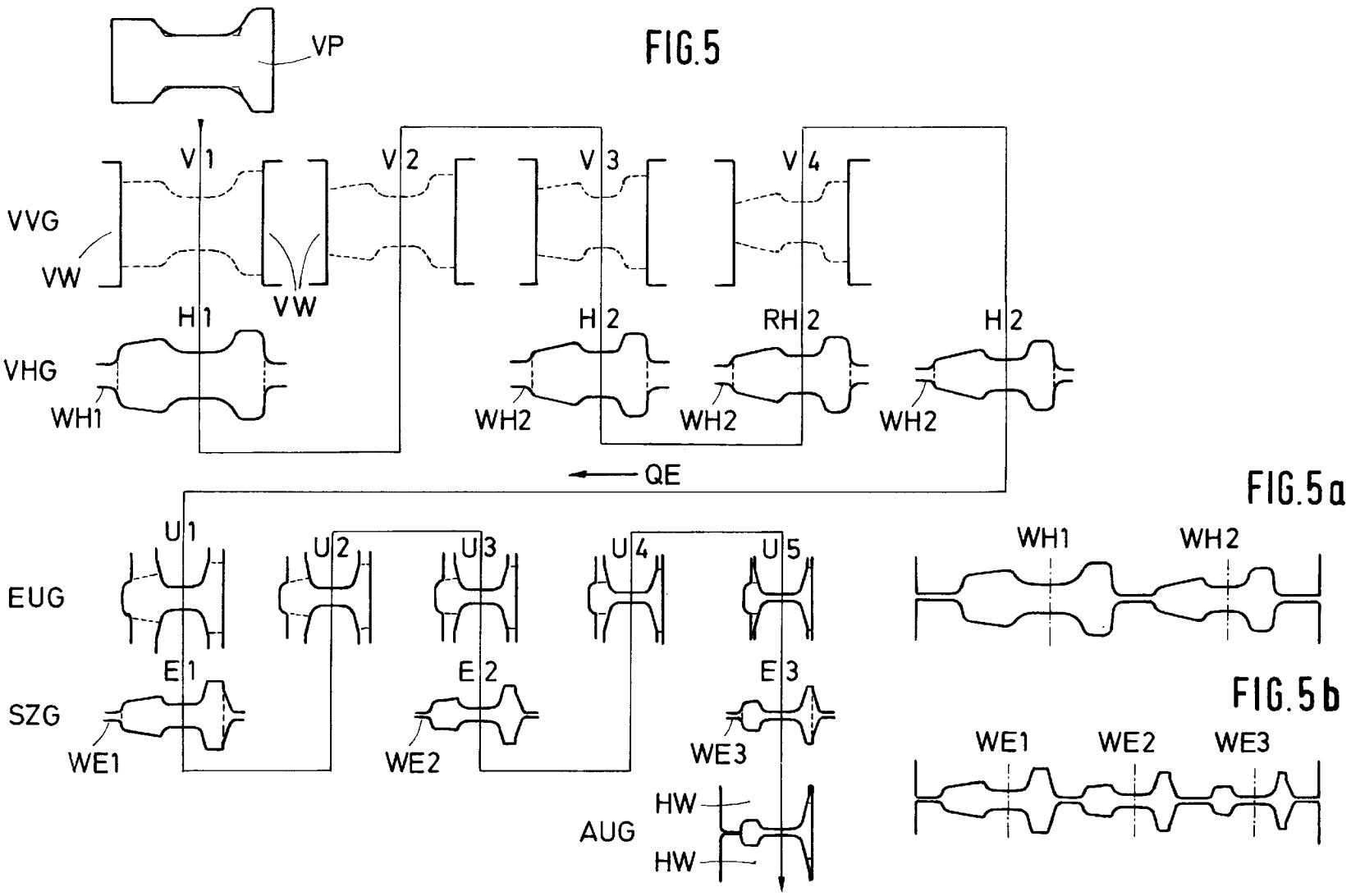
FIGS. 5, 5*a*, 5*b*, 6 and 7 are rolling schedules for carrying out the method in a roll stand arrangement according to FIG. 2.

In accordance with the rolling schedule shown in FIG. 5, a continuously cast preliminary section VP which already has an asymmetrical shape is conducted to the vertical two-high stand VVG and is upset using one groove V1. This pass V1 is followed by a pass H1 in the horizontal two-high stand VHG, another pass V2 in a reversing direction and a reversing pass V3 in the vertical two-high stand VVG, followed by a pass H2 and a pass RH2 in the second alternative pass WH2 of the horizontal two-high stand VHG, a subsequent pass V4 in the vertical two-high stand and then another pass H2 in a reversing direction in the second alternative pass WH2 of the horizontal two-high stand VHG. The preliminary section is then conducted by the transverse conveying unit QE to the compact rolling group and is then treated with 5 first passes, U1, E1, U2, U3, E2 in the manner illustrated in FIGS. 3 and 4. Subsequently, a pass U4 is carried out in a reversing direction and a reversing pass U5 is carried out in the universal stand EUG on the entry side, followed by a pass E3, in this case the 3rd alternative groove WE3 of the intermediate upsetting stand SZG and, as in the cases described above, the finishing pass is carried out with the profiled horizontal rolls HW of the universal stand AUG on the exit side.

The illustrated pass distribution between preliminary rolling group and finish rolling group represents a very balanced distribution of the deformation work to both rolling groups, wherein more passes are rolled in the finish rolling group; for this purpose, in contrast to the example described above, three instead of two alternative grooves are necessary in the finish rolling group.

Figures 6, 6A:
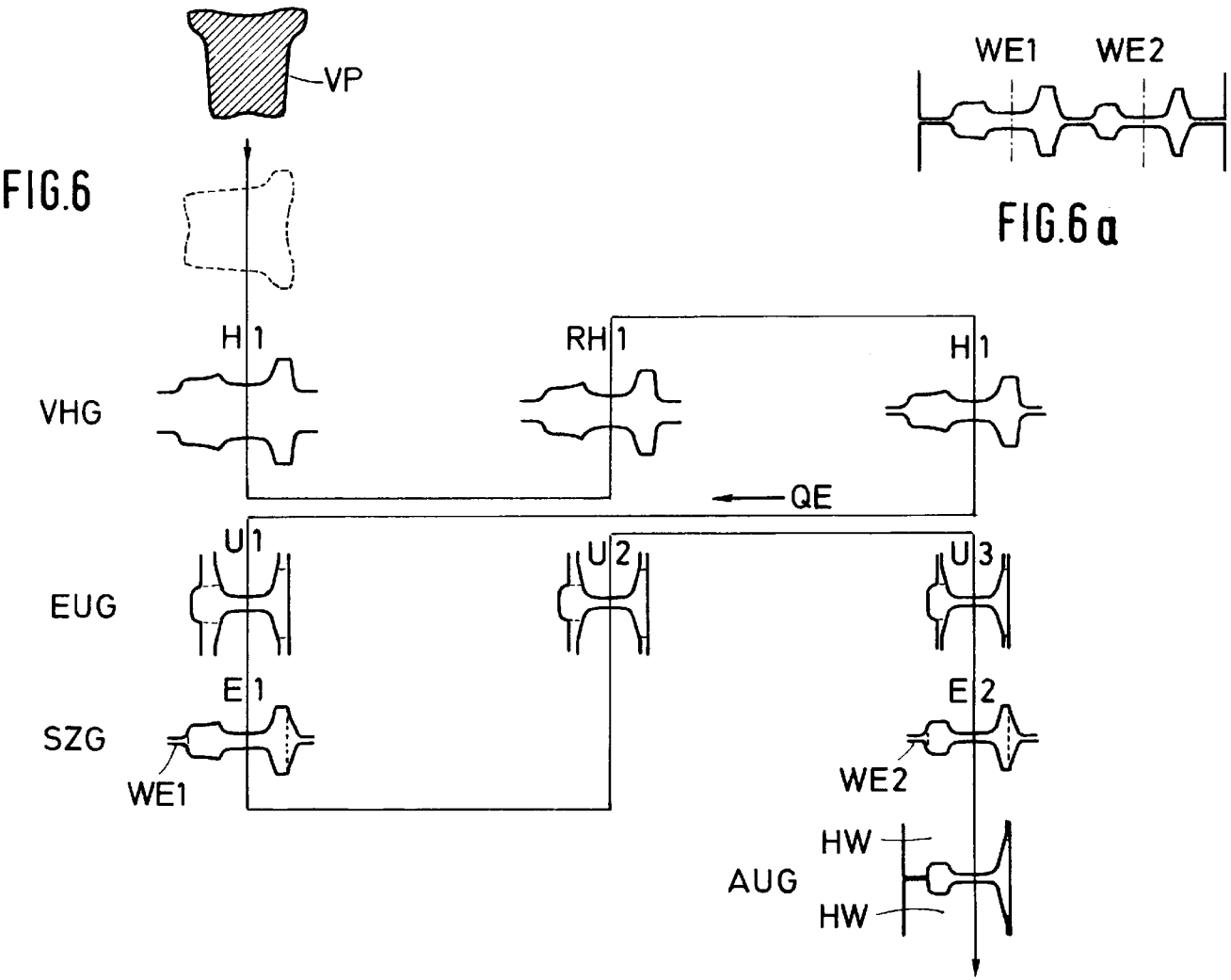

In accordance with the rolling schedule shown in FIG. 6, a continuously cast preliminary section VP is used which has a plug-shaped cross-section which is similar to the rail section to be rolled. As shown in broken lines, the preliminary section VP is placed horizontally and is directly conveyed to the horizontal two-high stand VHG of the preliminary rolling group and is reduced in the preliminary rolling group with successive reversing passes R1, RH1 and H1 to such an extent that it can be conveyed by the transverse conveying unit QE to the universal stand EUG on the entry side of the compact rolling group. After carrying out the pass U1 in the universal stand EUG, a pass E1 is carried out in the first alternative groove WE1 of the intermediate upsetting stand SZG, shown in FIG. 6*a,* and then another pass U2 is carried out in a reversing direction through the universal stand EUG on the entry side and a reversing pass U3 through the same stand, followed by another pass E2 in the second alternative pass WE2 of the intermediate upsetting stand SZG and the finishing pass through the universal stand AUG on the exit side. Because of the mass distribution in the continuously cast preliminary section, this rolling schedule requires only a preliminary rolling sequence with three passes in the horizontal two-high stand VHG of the preliminary rolling group and finish rolling in the compact rolling group corresponds to the sequence explained in connection with FIG. 4 with two alternative passes in the intermediate upsetting stand.

Figure 7:
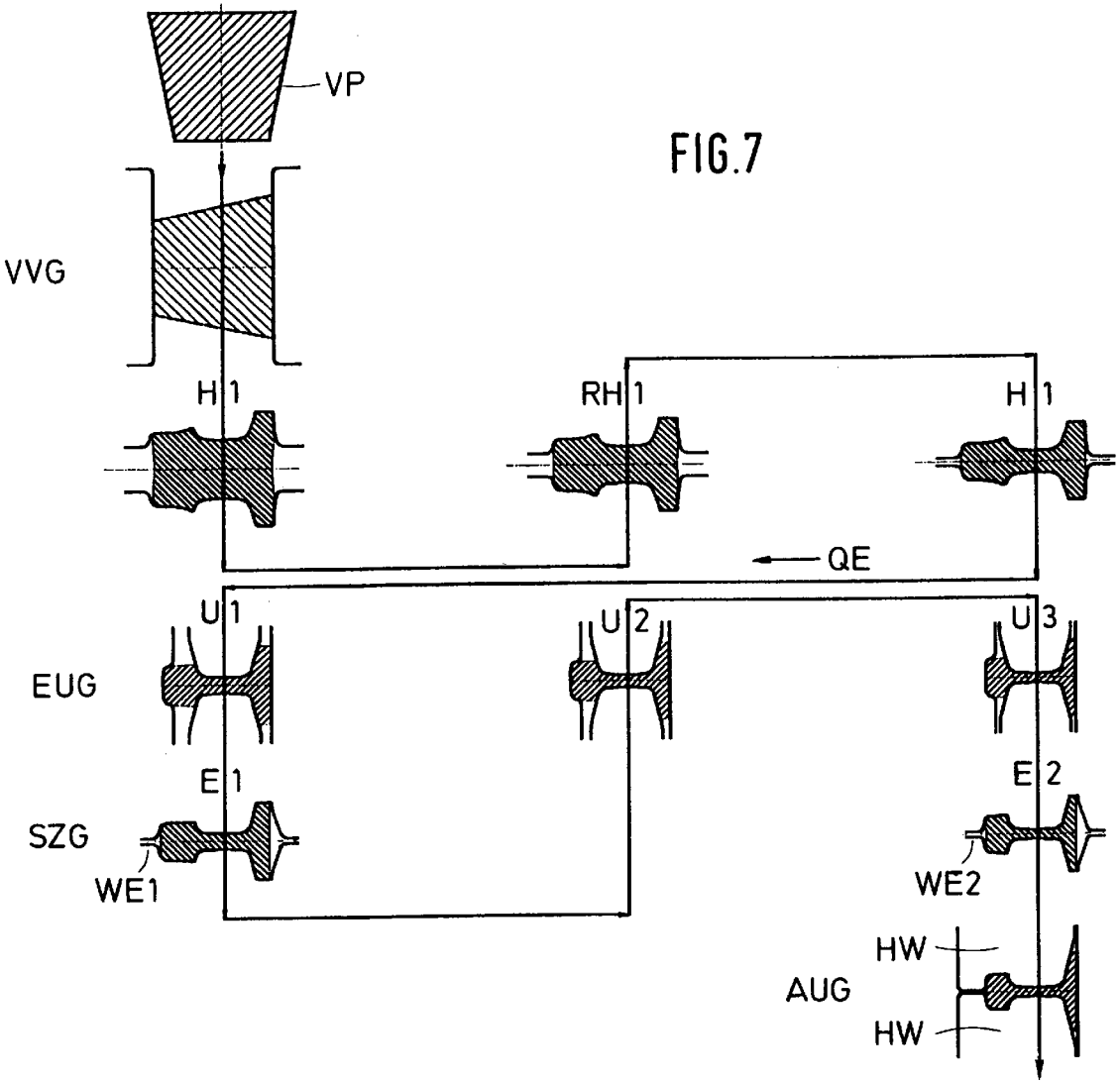

The preliminary section having a plug-shaped cross-section used in the rolling schedule according to FIG. 6 is very difficult to manufacture by continuous casting. Therefore, as shown in FIG. 7, it is also possible to use a preliminary section which has a trapezoidally-shaped cross-section which can be cast more easily. Contrary to the rolling schedule according to FIG. 6, the initial cross-section is conducted to the vertical two-high stand VVG of the preliminary rolling group in accordance with FIG. 2 and is then shaped and finish rolled in final passes in accordance with those of FIG. 6.

While specific embodiments of the invention have been shown and described in detail to illustrate the inventive principles, it will be understood that the invention may be embodied otherwise without departing from such principles.

We claim:

1. A method of rolling a rail section from a preliminary section by means of an arrangement operating in a reversing operation and including a compact rolling group having a rolling line and composed of a first universal stand on an entry side, a second universal stand on an exit side and an intermediate upsetting stand arranged between the first and second universal stands, wherein a preliminary rolling group having a rolling line and composed of two or more roll stands and having a free rolling stock run-out is arranged in front of the compact rolling group and transversely offset and parallel to the rolling line of the compact rolling group and a transverse shifting unit arranged between the rolling lines and in front of the compact rolling group, wherein the preliminary rolling group is equipped with a universal stand and a horizontal stand having two alternative grooves and the intermediate upsetting stand of the compact rolling group is also equipped with two alternative grooves, the method comprising shaping the preliminary section by initially carrying out five or more passes and reversing passes between the universal stand and the horizontal stand in each rolling group, wherein profiled horizontal rolls of the universal stand form in the section two indentations located opposite each other and offset relative to a longitudinal center of the section, subsequently preshaping head and flange projections of an emerging rail section and laterally reducing the indentations by means of one of the alternative grooves of the horizontal stand of the preliminary rolling group, rolling the emerging rail section in a reversing operation after three or more passes in the universal stand on the entry side of the compact rolling group and the two alternative grooves of the intermediate upsetting stand, and finish rolling the section into a rail section in an additional pass through the universal stand on the exit side.

2. The method according to claim 1, wherein the preliminary section has a rectangular cross-section.

3. The method according to claim 1, wherein the preliminary section has dog bone-shaped cross-section, further comprising forming the indentations in the center of the preliminary section by using the profiled rolls of the universal stand of the preliminary rolling group.

4. The method according to claim 1, wherein the preliminary section has a rail section-like cross-section, further comprising subjecting the preliminary section to an upsetting operation at both ends in a vertical stand instead of the universal stand in the preliminary rolling group, wherein the intermediate upsetting stand of the compact rolling group has three alternative grooves, wherein the preliminary section is dimensioned in such a way that one flange projection thereof corresponds to 1.2 to 4 times a head width and another flange projection corresponds to 1.2 to 3 times a base width of the finished rail section.

5. The method according to claim 1, wherein the preliminary section has a plug-shaped cross-section, further comprising preshaping the preliminary section in three successive passes in a reversing operation in a preliminary stand in the form of a two-high horizontal stand in the preliminary rolling group.

6. The method according to claim 1, wherein the preliminary section has a trapezoidally-shaped cross-section, further comprising preshaping the preliminary section in three successive passes in a reversing operation in a preliminary stand in the form of a two-high vertical stand in the preliminary rolling group.

* * * * *